US005501090A

United States Patent [19]

Mattiuzzo

[11] Patent Number: 5,501,090

[45] Date of Patent: Mar. 26, 1996

[54] FLEXIBLE HOUSING FOR CONVENTIONAL KEYS OR FOR KEYS OF A SPECIAL KIND

[75] Inventor: Mario Mattiuzzo, Breda Di Piave, Italy

[73] Assignee: C.E.A. S.P.A., Lovadina Di Spresiano, Italy

[21] Appl. No.: 190,080

[22] PCT Filed: Jul. 27, 1992

[86] PCT No.: PCT/IT92/00087

§ 371 Date: Mar. 25, 1994

§ 102(e) Date: Mar. 25, 1994

[87] PCT Pub. No.: WO93/02587

PCT Pub. Date: Feb. 18, 1993

[51] Int. Cl.[6] ..... A45C 11/32; E05B 19/24

[52] U.S. Cl. ..... 70/458; 70/408; 70/457; 70/456 R; 206/37.1

[58] Field of Search ..... 70/456 R, 408, 70/457, 458, 460; 206/37.1

[56] References Cited

U.S. PATENT DOCUMENTS

| | | | |
|---|---|---|---|
| 2,734,624 | 2/1956 | Kernicki | 70/456 R |
| 4,637,236 | 1/1987 | Almblad | 70/458 |
| 4,677,835 | 7/1987 | Almblad | 70/458 |
| 4,741,335 | 7/1990 | Allen | 70/458 |
| 4,901,547 | 2/1990 | Dal Palv | 70/458 |
| 4,936,123 | 6/1990 | Matsuda | 70/456 R |
| 4,946,030 | 8/1990 | Guridi et al. | 206/34.1 |
| 4,959,983 | 10/1990 | Hsu | 70/456 R |
| 5,022,247 | 6/1991 | Beck | 70/458 |
| 5,046,343 | 10/1991 | Miwa | 70/408 |
| 5,232,528 | 8/1993 | Reznickenko et al. | 70/460 |
| 5,311,758 | 5/1994 | Neitzke et al. | 70/458 |

FOREIGN PATENT DOCUMENTS

| | | | |
|---|---|---|---|
| 0327908 | 8/1989 | European Pat. Off. . | |
| 0340336 | 11/1989 | European Pat. Off. . | |
| 2634634 | 2/1990 | France . | |
| 2661806 | 11/1991 | France | 70/458 |
| 3827536 | 11/1989 | Germany . | |
| 58-134982 | 3/1982 | Japan | 70/458 |
| 402646 | 5/1986 | Switzerland | 70/46 |
| 845526 | 8/1960 | United Kingdom . | |

*Primary Examiner*—Darnell M. Boucher
*Attorney, Agent, or Firm*—Young & Thompson

[57] ABSTRACT

Housing (1, 20) for lodging conventional flat keys or keys of a special kind (2, 2*a*, 2*b*'–2*b*", 2*c*, 2*d*), in a safe but removable way. The laminar housing (1, 20) is realized by elastically flexible plastic material s of a type and form like a rectangular "credit card", and it is provided with a central opening (5, 21) whose peripheral edge (10, 22) defines a space for lodging a key or more superimposed keys. At the site of the opening (5, 21), elastic seizing elements (7—7) may project out of the housing (1, 20) acting on the lateral fins of the heads (3, 3*a*, 3*b*, 3*c*) or on the stems (4, 4*a*, 4*c*, 4*d*) of the keys.

2 Claims, 3 Drawing Sheets

FIG. 5
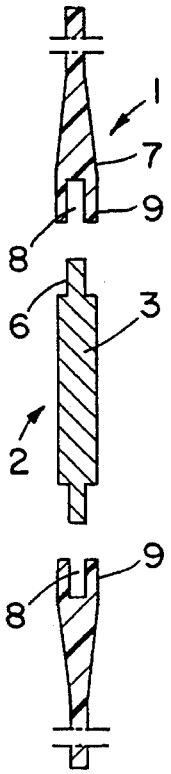
FIG. 6
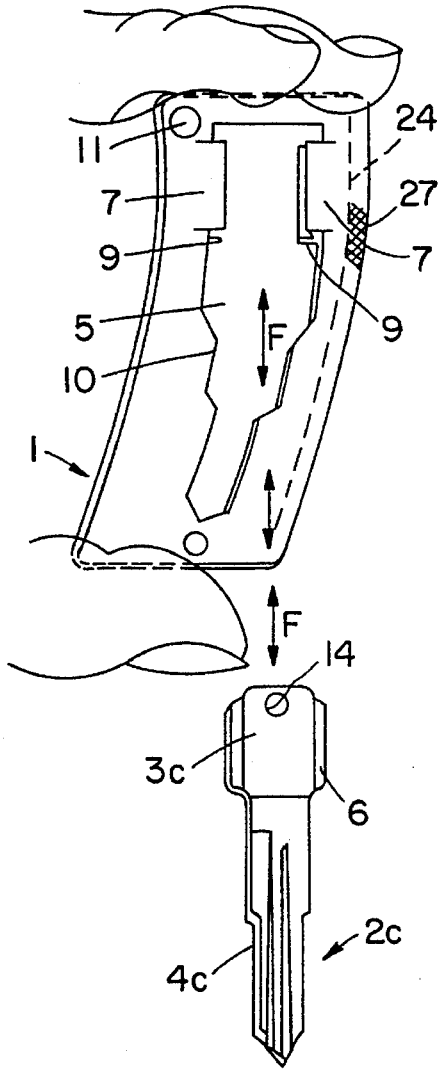
FIG. 8
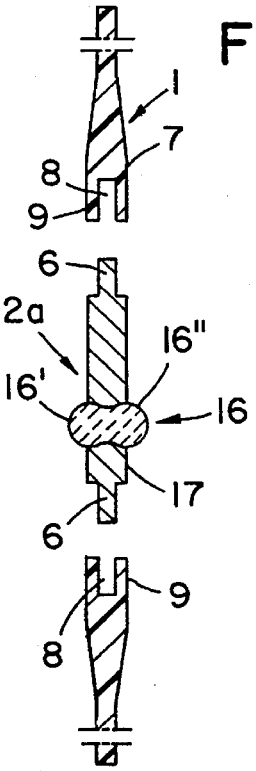
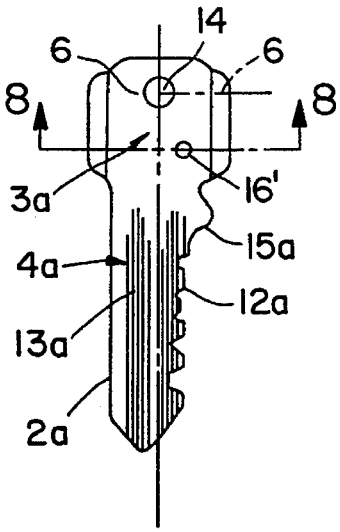
FIG. 7

FLEXIBLE HOUSING FOR CONVENTIONAL KEYS OR FOR KEYS OF A SPECIAL KIND

BACKGROUND OF THE INVENTION

1. Field of the Invention

This invention relates to an elastically flexible laminar housing, realized in the shape and dimension of a credit card and comprising a central aperture or cavity, shaped so as to be capable of lodging a key or two superimposed keys. Said housing comprises means for elastically grasping and holding in position in a removable way, part of the head or the stem of the key or keys which are inserted in it, allowing the engagement or the disengagement after the users hand has bent said laminar housing.

2. Description of the Related Art

Several rigid supporting housings are known from the prior art, which are realized by means of plastic materials and comprise lodging seats for one or more keys.

We refer in particular to U.S. Pat. Nos. 4,637,236 and 4,677,335 which disclose rigid housings provided with adequate seats for receiving the keys, and with projections which face corresponding cavities obtained in the keys and apt to hold said keys so as to let them adhere to the housing, allowing the disengagement of the key and its use in the correct position. However even if they have a certain effectiveness, said rigid supports have disadvantages due to difficult handling during the disengagement of the key and during its subsequent engagement inside the supporting housing.

There are other disadvantages and costs which must be taken into account, due to an additional working of the key components, both for plastic and metal components.

Keys made of a plastic material which are realized taking into account the corresponding structure of the supporting housing which holds them in position, must be inclined in particular suitable positions with respect to the supporting housing, so that they may be disengaged and used; once they have been disengaged from the supporting housing, however, they cannot be replaced in it.

SUMMARY OF THE INVENTION

The present invention eliminates these draw backs and disadvantages by providing a housing having the following advantages:

- it allows a person to use flat keys for conventional type locks or flat - key - locks, and keys being shaped to a particular form and comprising means to realize the correct engagement of the key inside the housing or its disengagement therefrom; furthermore, it allows the quick and correct engagement of the key inside the corresponding keyhole;
- it is able to hold said keys safely in position, allowing repeated engagements and disengagements of the keys with respect to their housing, through a simple and intuitive handling;
- it is realizable by means of a single structure, obtained by choosing suitable polymer plastics of a deformable type; and
- it is capable of protecting in a substantially complete fashion the operating segments of the key carrying the cutting code on the stem, allowing a correct handling of the key.

The laminar flexible housing for holding keys, according to the present invention, has the following peculiarities:

- it is made of a laminar single structure having a shape like that of a "credit card";
- it is provided with a central opening for the lodging of at least one key of a flat conventional type; and
- it is provided with a lateral portion apt to receive a band or the like, on which the coded data of the respective key are reproduced, so as to permit one to identify the key by sensors or transducers of duplicating machines of the keys and for any other purpose. The invention refers in particular also to non conventional flat keys, to be employed in combination with said housing, and which have the following peculiarities:
  - they are realized in a single metallic piece with parts related to the lodging seats obtained in the flexible housings;
  - they are provided with reference means to permit the identification by the user of the exact seizing position of the key during its disengagement from the housing and during its engagement inside the key-hole:
  - shape modifications of the head of the keys are provided, which are associated with means for joining together two keys to be engaged inside the same housing; said keys may be separated after their disengagement from the housing, allowing the separate use of each key;
  - if required, the structure of the keys may be of a composite type, in particular their head may be realized by means of a plastic material of different colours so as to facilitate the rapid recognition of each key; said head engages a pin projecting out of the upper part of the key's stem, the stem itself being made of a metallic material, preferably realized with a resistant alloy.

BRIEF DESCRIPTION OF DRAWINGS

Other peculiarities and advantages of the invention will be more clearly understood by means of the following description, with the help of the annexed drawing figures, which must be considered illustrative and not restrictive, and in which:

FIG. 5 is an enlarged and exploded cross sectional view obtained along line 2—2 of FIG. 1, when the key of FIG.4 is engaged inside the housing of FIGS. 1 and 3;

FIG. 6 is a perspective view which shows three fingers of the user which bend the housing Of FIG. 1, in order to engage the key inside the housing of FIG. 1 or in order to disengage it therefrom:

FIG. 7 shows a key of the kind of that shown in FIG. 4, but provided with a shaped pin passing through the head of the key and projecting out from both faces of the head of said key, said pin having ends like spherical bowls and serving as a reference means to permit the correct engagement of the key inside the key-hole when it is disengaged from the housing;

FIG. 8 is the partial cross- section, enlarged and exploded, obtained along line 8—8 of FIG. 7, through the head of the key of FIG. 7, and through the housing of FIG. 1;

DETAILED DESCRIPTION OF THE PREFERRED EMBODIMENTS

Figure 1:
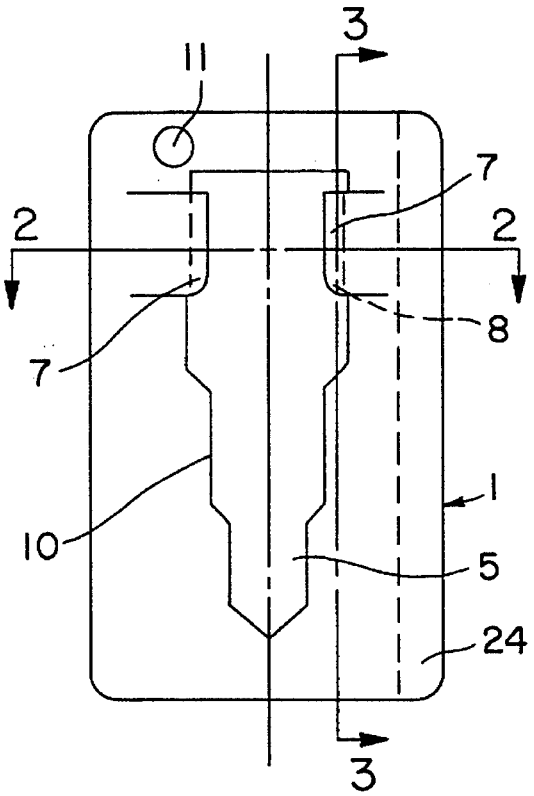
FIG. 1 shows the front view of a laminar flexible housing for holding keys, of a shape and type similar to a "credit card", which does not yet contain the key, according to a first embodiment.
Figure 3:
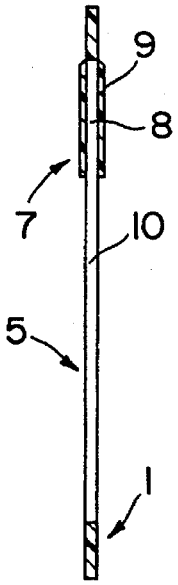
FIG. 3 shows the longitudinal cross section of the housing, along line 3—3 of FIG. 1.
Figure 4:
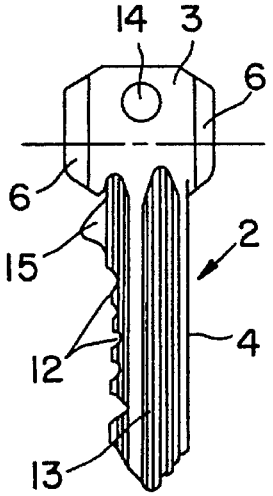
FIG. 4 shows one of the faces of a flat key, to be engaged in a removable way inside the housing of FIG. 1, the cross-section line on the key coinciding with section line 2—2 when the key is in the housing.

FIG. 1 and FIG. 3 refer to a first embodiment of a housing 1 of a laminar type, having a substantially rectangular shape, which is obtained by means of an elastically flexible plastic material which can be bent and can regain its original flat form in a non stressed condition; said housing 1 therefore look like a common plaque of the type of a "credit card", said plaque being realized and shaped so as to be able to lodge and hold in position in a removable way, a key 2 of a flat type which comprises a head 3 and a stem 4, provided with means to effect the cutting code, as for example the key shown in FIG. 4. FIG. 1 shows in particular a front view of the housing 1 in a flat non stressed arrangement.

Figure 9:
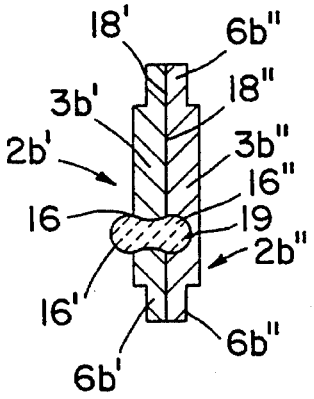
FIG. 9 is the horizontal cross section along line 8—8 of FIG. 7, through the head of a first key, in which the fins or blocking means, corresponding to the seats of the housing, are aligned to one of the faces of the respective head, one of the faces of said first key being flat so as to be applied and connected to a second key with a peculiar configuration of its head, the two keys being attachable to each other by means of said shaped pin which is provided to permit the correct engagement of both keys in the corresponding locks, said fins being located centrally when the two heads are in contact.

In the center of the housing 1 there is a cavity or opening 5 having a peripheral edge 10 shaped so as to define a space having a form which is apt to lodge a key 2 inside it, or two superimposed keys 2*b'*, 2*b'* of FIG. 9. In the region of the opening or cavity 5 which serves for lodging the head 3 of the key 2, said head 3 (FIG. 4) is provided on its lateral sides, with projecting fins 6 having a reduced thickness in comparison to that of said head 3 so as to form shoulders on the body of the head 3 on both sides of the faces of said fins 6, the fins 6 being apt to be held in position by shaped projecting elements 7 which extend beyond the peripheral edge 10 inside the space of the opening 5, so as to grasp the fins 6 of the key 2.

Figure 2:
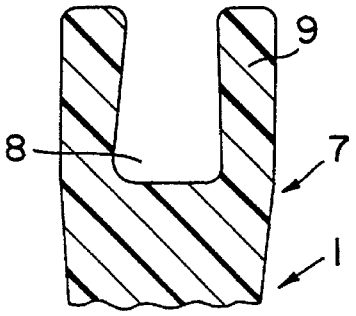
FIG. 2 shows a detail of the horizontal cross section of the housing, along line 2—2 of FIG. 1.

FIG. 2 shows on an enlarged scale the details of the configuration of said elements projecting inside the cavity 5, represented through a horizontal cross section taken along line 2—2 of FIG. 1. The wall of the housing 1 near the opening 5 for the lodging of the key 2 inside the opening 5, and in particular in the region apt to receive the head 3 of the key 2. The thickness of the fins 6 of the keys 2 determines the relief of the shaped projecting elements 7 above the level of the surfaces of the housing, and a slot 8 is formed inside each of said projecting elements 7 (FIG. 2), having a section similar to a swallow's tail which is defined by the opposed faces of lateral fins 9, which approach each other more and more in order to realize a notable seizing pressure on the fins 6 of the head 3 of the key 2. The projecting pressure must allow the sliding of the fins 6 of the head 3 inside the fins 9 of the grasping elements 7 of the housing 1.

FIG. 3 shows, on the other hand, the longitudinal cross section of the housing 1, taken along the line 3—3 of FIG. 1, which is parallel to the centerline, defining the longitudinal symmetry plane of the housing 1, said cross- section passing through the elements 7 projecting inside the opening 5 of the housing 1.

FIG. 5, on the other hand, as has been said above, represents on an enlarged scale the exploded cross section taken along the line 2—2 of FIG. I and along the corresponding broken line drawn on the key 2 of FIG. 4, when the latter is engaged inside the opening 5 of the housing 1.

With reference to FIG. 1, a hole 11 is provided near one of the upper vertices of the housing 1 in order to hang up several housings 1 on a hook of an appending means.

Considering again FIG. 4, it can be noted that the key 2 is of a kind known per se and comprises in at least one of the lateral edges of the stem 4, below a shoulder 15, a plurality of suitably shaped teeth 12 and on the faces of the stem, a plurality of slots 13 which provide a cutting code of the key 2. Through the upper part of the head 3 of the key 2, there is provided a conventional through hole 14 in order to hang up the key 2 on a holding ring for keys, to a hook or the like.

FIG. 6 shows a perspective view of the housing 1 while it is bent by the fingers of the user, two fingers grasping the upper horizontal edge of the housing 1 and one finger seizing the lower edge of the same, when a key 2*c*is to be engaged inside the housing 1, in such a way that the lateral fins 6 of the key 2 will be introduced inside and between the projecting elements 7, while being compressed in opposed directions between the fins 9 of the respective housing 1; or, when said key 2*c* is to be disengaged from the housing 1, one operates in an opposed manner along the direction indicated by the arrows F in FIG. 6. On one side of the housing 1, a strip 24 may be provided in order to receive a band 27 or the like, carrying the coded data of the key, for allowing an optical reading by means of optical sensors and transducers of key-duplicating machines, or for other purposes.

FIG. 7 shows a second kind of key 2*a*, whose head 3*a* is substantially identical to that of the key 2 of 4, so that the different operative parts of said head 3*a* are indicated by the same numbers used in FIG. 4. On the other hand, the stem 4*a* of the key 2*a* modified with respect to the identifying components which are teeth 12*a* and slots 13*a* of key 2*a*.

Through the head 3*a*of said key 2*a*, there passes a pin 16 (see FIG. 8) which projects out of the opposite faces of said key 3*a*, widening and forming cambers 16' and 16", the pin 16 passing through a hole 17 (see FIG. 8) obtained in the body of the key 2*a*, whose axis is laterally shifted with respect to the longitudinal symmetry plane of said head 3*a* of the key 2*a* in FIG. 7.

The camber 16' projecting out of the face of the head 3*a* in FIG. 7, realizes a reference means for the correct removal of the key 2*a* from the housing 1, for its displacement towards the key-hole of the respective lock, and its engagement in the latter in the exact operative position.

FIG. 8 shows, on an enlarged scale, an exploded view of the cross section of the key 2*a* and of the housing 1 taken at the level of the axis of the pin, along the line 8—8 of FIG. 7.

Said pin 16 may also be used in order to join together two keys 2*b'* and 2*b"* of FIG. 9 and in order to engage them inside the same housing 1.

In FIG. 9 there is shown the cross section of their heads 3*b'* and 3*b"*, which view is obtained at the section plane defined by line 8—8 of FIG. 7. According to this solution, the heads 3*b*' and 3*b*" of the keys 2*b*" and 2*b*" are mirrow-like. In fact, each of them has a planar face 18' and 18", and said faces are made to adhere, while the external faces of the heads 3*b*' and 3*b*" are "substantially" equal to those of the key 2 of FIG. 4, apart from the fact that the fins 6*b*' and 6*b*" of the head 3*b*' and 3*b*" have a reduced thickness in comparison to that of the fins 6 of the head 3 of key 2, and they realize a shoulder only when the ensemble constituted by the two heads 3*b*' and 3*b*" is joined together.

The shaped pin 16 will be held inside the hole 17 of the head 3*b*'of key 2*b*', as shown in FIG.9, but on the face 18" of the head 3*b*" and in the region thereof which is adjacent to the camber 16" of the pin 16 projecting out of the face 18". A recess 19 is provided, which has a complementary shape with respect to the camber 16" of the pin 16, and which serves for the engagement in its interior by means of pressure, of the camber 16" of pin 16; in this way, both heads 3*b*' and 3*b*" of the keys 2*b*' and 2*b*" can be coupled one against the other correctly, as may be seen from FIG. 9.

Therefore, after this coupling, the two keys 2*b*' and 2*b*" form a unique ensemble in which on the external face of head 3*b*' there appears only the camber 16' of pin 16, acting as a reference means for the user, in order to engage or to disengage said ensemble of keys 2*b*', 2*b*" with respect to the housing 1, separating subsequently the two keys 2*b*'and 2*b*" from each other. It will be noted as regards key 2*b*', that the camber 16' of pin 16 will facilitate the correct seizing of the key 2*b*' and its engagement inside the key-hole of the lock, whereas, in the case of key 2*b*", the recess 19 will act as a visible means which facilitates the user's correct seizing of the key and its correct engagement inside the respective key-hole indicating the correct rotational sense required for opening or closing the lock.

Figure 10:
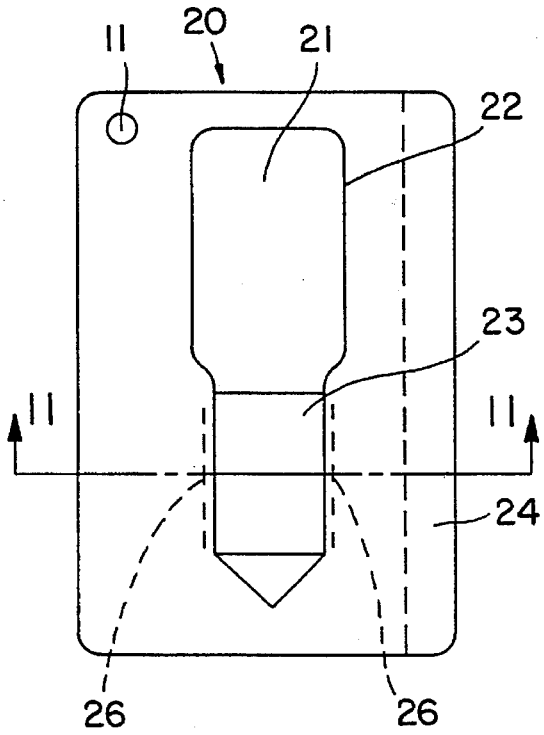
FIG. 10 shows the front view of a second embodiment of a laminar flexible housing, comprising a shaped cavity for lodging at least one key, said cavity having a pocket on its lower part for lodging at least part of the stem of said key or keys.

The keys 2, 2*a*, and 2*b*'–2*b*", 2*c*, 2*d* have preferably their heads 3, 3*a*, and 3*b*'–3*b*" realized by means of a plastic material, having different colours, and they are apt to be fitted on the metallic stems 4, 4*a*, etc. which may also be realized by means of an alloy. FIG. 10 shows a second embodiment of a housing 20 for holding keys, and has the same peculiarities described above, with reference to the first embodiment but in which a flat key of any kind may be inserted, because the engagement of the key inside said housing 20 is done on at least a lower portion of the stem of said key. There is a shaped opening or cavity 21 for the lodging of the key, said cavity 21 being defined by a peripheral edge 22 so as to realize a central space inside the housing 20 which is apt to receive at least the head of the engaged key, whereas in the lower region of the cavity 21, there is provided a pocket 23 for the introduction of at least the lower end portion of the stem of a key. A conventional hole 11 is provided in order to hang up the housing 20, with or without the key, to a convenient supporting means.

Figure 11:
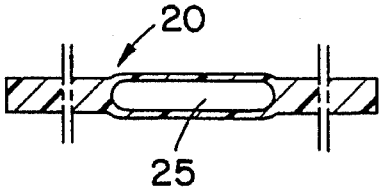
FIG. 11 shows the horizontal cross section of the housing of FIG. 10, along line 11—11 of FIG. 10, at the site where the pocket of said housing is realized.

It is to be noted, that in this embodiment every kind of key may be engaged inside the housing 20, and that the pocket 23 for the lodging of the stem of the key or keys, also represents a useful protection of the "ciphering" elements of the keys, allowing the handling of the keys as regards their engagement or disengagement from the housing 20, by simply holding the keys on their respective heads. A lateral longitudinal strip 24 of the housing 20 may be used for receiving a band 27 shown in FIG. 12 or any equivalent means carrying the coded data which are necessary for the reading done by optical readers or transducers of duplicating machines for said keys. FIG. 11 shows an unproportional drawing of the cross section of the housing 20, taken along line 11—11 of FIG. 10, in the region occupied by the pocket 23 defining an internal cavity 25 which has a slightly less thickness than that of the key or keys to be engaged in it, in order to realize a sure seizing of the key or keys.

The space forming the internal cavity 25 inside the pocket 23 may be such that it may be oriented/inclined by means of elements 26 capable of sensibly inclining the cavity 25 of the pocket 23 in order to allow the user to rotate the key in two opposite rotational directions, by acting on the key's head, during the engagement of the key inside the housing 20 or during its disengagement therefrom.

Figure 12:
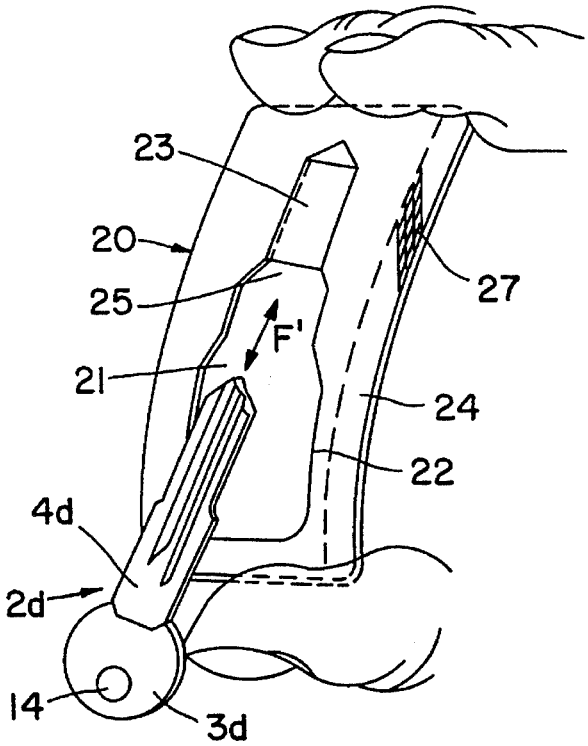
FIG. 12 shows a perspective view of the housing of FIG. 10 when the user's hand causes the bending of the same, in order to allow the engagement of at least part of the stem of one or more keys inside said pocket, or alternatively, its disengagement.

FIG. 12 is a perspective view which illustrates the way of employment, in order to engage a key 2*d* inside the housing 20 or to disengage it therefrom; this operation is done in the same manner as described above with reference to FIG. 6, with the only difference that in this case, the user will grasp the key 2*d* on its head 3*d* in order to engage or to disengage the key 2*d* from the housing 20, and he operates in the directions of the arrows F'.

I claim:

1. A laminar housing and key combination in which one or more flat keys are retained in said housing in a removable way, said flat keys having heads (3, 3*a*, 3*b*, 3*c*, 3*d*) and stems (4, 4*a*, 4*c*, 4*d*) made of a metallic material and including thereon shaped teeth and longitudinal slots with one of a cylindrical, conical and tapered cross section, in order to realize a profile of a respective key (2, 2*a*, 2*b*'–2*b*", 2*c*, 2*d*); said housing (1, 20) comprising:

an elastically flexible plastic card having a substantially rectangular form;

said housing (1, 20) also being centrally provided with an opening or cavity (5, 21) with a peripheral edge (10, 22) that forms a closed profile and that encloses an area conforming to a shape of said key (2, 2*a*, 2*b*'–2*c*, 2*d*);

means (7, 7, 23) for seizing and holding the key in position, said seizing means being provided at said opening or cavity (5, 21), whereby engagement and disengagement of the respective key from the laminar housing (1, 20) is facilitated by a longitudinal bending involving no torsion of said elastically flexible plastic card by a user's hand;

wherein said seizing means (7—7) act on the lateral edges of the heads (3, 3*a*, 3*b*'–3*b*", 3*c*) of said flat keys, each of said heads being provided with fins (6—6, 6*b*'–6*b*', 6*b*"—6*b*"), having a reduced thickness, said fins being held by the seizing means (7) that extend beyond the peripheral edge (10) inside the opening or cavity (5) adjacent to the fins;

said housing (1) also having at least a nondecreasing thickness at the seizing means (7) in which slots (8) face each other and have lateral walls (9) that approach each other in order to compress from both sides said fins (6—6, 6*b*'—6*b*', 6*b*"—6*b*") on each head;

said housing (1) also including a strip means (24) for receiving a band means (27) for carrying coded data of the key, for reading by a sensor and transducer of a duplicating machine;

wherein one of said keys (2*a*) is provided with a through hole (17) for engagement of a pin (16) having ends which are enlarged and which have cambers (16', 16"), in order to hold the pin (16) in position on the head (3*a*) of the key (2*a*), thus preventing movement; and said pin (16) having its longitudinal axis parallel to and offset with respect to a longitudinal symmetry plane (Y—Y) of the head (3*a*) of the key (2*a*)

said camber (16') of said pin (16) acting as a reference and recognition means for correct placement of the key (2*a*) inside the housing (1), said reference and recognition means being tactile means which project out of the head (3*a*) of the key (2*a*) for identification of a correct position of engagement of the key (2*a*) in a key-hole.

2. A laminar housing and key combination in which a pair of flat keys is retained in said housing in a removable way, said flat keys having heads (3, 3*a*, 3*b*, 3*c*, 3*d*) and stems (4, 4*a*, 4*c*, 4*d*) made of a metallic material and including thereon shaped teeth and longitudinal slots, in order to realize a profile of a respective key (2, 2*a*, 2*b*'–2*b*", 2*c*, 2*d*);

said housing (1, 20) comprising:

an elastically flexible plastic card having a substantially rectangular form;

said housing (1, 20) also being centrally provided with an opening or cavity.(5, 21) with a peripheral edge (10, 22) that forms a closed profile and that encloses an area conforming to a shape of said key (2, 2*a*, 2*b*'–2*b*", 2*c*, 2*d*);

means (7, 7, 23) for seizing and holding the key in position, said seizing means being provided at said opening or cavity (5, 21), whereby engagement and disengagement of the respective key from the laminar housing (1, 20) is facilitated by a longitudinal bending involving no torsion of said elastically flexible plastic card by a user's hand;

wherein said seizing means (7—7) act on the lateral edges of the heads (3, 3*a*, 3*b*'–3*b*", 3*c*) of said flat keys, each of said heads being provided with fins (6—6, 6*b*'–6*b*', 6*b*"–6*b*"), having a reduced thickness, said fins being held by the seizing means (7) that extend beyond the peripheral edge (10) inside the opening or cavity (5) adjacent to the fins;

said housing (1) also having at least a nondecreasing thickness at the seizing means (7) in which slots (8) face each other and have lateral walls (9) that approach each other in order to compress from both sides said fins (6—6, 6*b*'–6*b*', 6*b*"–6*b*") on each head;

wherein said housing (1) keeps the pair of flat keys (2*b*', 2*b*") simultaneously, said pair of flat keys (2*b*', 2*b*") having heads (3*b*', 3*b*") with faces shaped with shoulders forming the fins (6*b*', 6*b*"), wherein respective opposed faces (18', 18") are planar and are joined to each other, so that the heads (3*b*', 3*b*") are aligned symmetrically with respect to a plane of contact therebetween;

said fins (6*b*', 6*b*', 6*b*", 6*b*") each having a thickness not surpassing half of the thickness of the slots (8) of the housing (1), so that the heads (3*b*', 3*b*") form combined composite fins (6*b*', 6*b*") which engage in the slots (8) of the seizing means (7) in the housing (1); and said head (3*b*') of one key (2*b*') being provided with the pin (16), having the cambers (16', 16"), whereas at the camber (16") of said pin (16), on one of the opposed faces (18') of the head (3*b*") of the other key (2*b*"), there is provided a recess (19) having a complementary form with respect to the camber (16") of said pin (16), and which complementary form serves to engage the camber (16") inside the recess (19) without any pressure, in order to hold the pair of flat keys (2*b*', 2*b*") together in an easily detachable way;

said camber (16') of the pin (16) representing visible and tactile reference means for correct engagement of the pair of keys (2*b*', 2*b*") inside the housing (1).

* * * * *